US006011943A

United States Patent [19]

Kim

[11] Patent Number: 6,011,943

[45] Date of Patent: Jan. 4, 2000

[54] INK DELIVERY SYSTEM FOR LIQUID ELECTROPHOTOGRAPHIC PRINTER

[75] Inventor: Jong-woo Kim, Yongin, Rep. of Korea

[73] Assignee: Samsung Electronics Co., Ltd., Kyungki-do, Rep. of Korea

[21] Appl. No.: 09/107,445

[22] Filed: Jun. 30, 1998

[30] Foreign Application Priority Data

Feb. 27, 1998 [KR] Rep. of Korea ..... 98-6480

[51] Int. Cl.[7] ..... G03G 15/10

[52] U.S. Cl. ..... 399/238; 399/237; 399/239; 399/247

[58] Field of Search ..... 399/237, 238, 399/246, 247, 249, 250, 251, 359, 360, 348; 118/600, 602, 603, 610; 430/117, 118

[56] References Cited

U.S. PATENT DOCUMENTS

| | | | |
|---|---|---|---|
| 5,003,352 | 3/1991 | Duchesne et al. | 399/348 |
| 5,442,427 | 8/1995 | Day | 399/348 |
| 5,634,170 | 5/1997 | Knapp et al. | 399/29 |
| 5,742,302 | 4/1998 | Kohri et al. | 347/23 |
| 5,837,138 | 11/1998 | Boele | 210/237 |

*Primary Examiner*—William Royer
*Assistant Examiner*—Hoang Ngo
*Attorney, Agent, or Firm*—Sughrue, Mion, Zinn, Macpeak & Seas, PLLC

[57] ABSTRACT

An ink delivery system for a liquid electrophotographic printer is provided. The system includes a circulation tank connected to the development unit and in which the developer liquid to be supplied to the development unit is stored, a jet portion disposed between the circulation tank and the development unit, for jetting the developer in the circulation tank to a development gap in the development unit, an ink supplier in which concentrated ink is stored, a first supply path through which the concentrated ink accommodated in the ink supplier is supplied to the circulation tank, a carrier tank fixed in a printer body and in which the carrier to be supplied to the circulation tank is stored, a second supply path through which the carrier in the carrier tank is supplied to the circulation tank, a waste ink disposal tank connected to the circulation tank, for collecting the waste ink in the circulation tank, and a filtering mechanism installed between the waste ink disposal tank and the carrier tank, for filtering the waste ink in the waste ink disposal tank to supply the carrier to the carrier tank.

10 Claims, 4 Drawing Sheets

INK DELIVERY SYSTEM FOR LIQUID ELECTROPHOTOGRAPHIC PRINTER

BACKGROUND OF THE INVENTION

1. Field of the Invention

The present invention relates to an ink delivery system for a liquid electrophotographic printer, and more particularly, to an ink delivery system for a liquid electrophotographic printer having a structure which enables recycling of a liquid carrier separated from ink supplied through an ink supplier.

2. Description of the Related Art

In general, in an electrophotographic printer, a latent electrostatic image is formed on a photosensitive medium such as a photoreceptor belt, by irradiating laser beams onto the photosensitive medium by a laser scanning unit (LSU), and then the latent electrostatic image is developed by supplying a developer liquid containing a toner mixed with a carrier, which is then transferred to a sheet of print paper.

As shown in FIG. 1, a conventional development apparatus includes a laser scanning unit (LSU) for forming an image corresponding to a latent electrostatic image on a photoreceptor belt 10, a drying unit 30 for drying a carrier remaining on the photoreceptor belt 10 after development, and an ink delivery system 40 for supplying a developer liquid of predetermined concentration and volume suitable for development, and recovering a carrier dried by the drying unit 30 after it is used in development.

The developer liquid is ink of a concentration of about 2~4wt % obtained by mixing concentrated ink containing about 9 wt % powdered toner supplied from an ink cartridge 41 and a liquid carrier supplied from a carrier cartridge 43.

The ink delivery system 40 includes an ink cartridge 41 in which concentrated ink is stored, a carrier cartridge 43 in which a carrier is stored, a circulation tank 44 in which a developer liquid is stored, and a jet portion 47 for jetting the developer liquid to a development gap G between a development roller 21 for the development unit 20 and the photoreceptor belt 10 positioned corresponding thereto. The ink cartridge 41 includes an agitator 42 by which the concentrated ink accommodated therein is not precipitated, and is disposable, and can be replaced when the concentrated ink is used up. Also, the carrier cartridge 43 is disposable and can be replaced when the carrier contained therein is used up.

The circulation tank 44 is installed underneath the development unit 20, and supplies developer liquid to the development unit through the jet portion 47 and receives the residual developer liquid after being used for development so that the developer liquid is continuously supplied to the development gap G during development. A concentration sensor 45 for sensing the concentration of the developer liquid contained in the circulation tank 44, an upper limit level sensor 46*a* and a lower limit level sensor 46*b*, installed in the upper and lower portions of the circulation tank 44, for sensing the amount of developer liquid contained in the circulation tank 44, are installed in the circulation tank 44.

The jet portion 47 includes a jet path 47*a* through which the developer liquid is supplied, a jet pump 47*b* installed in the jet path 47*a* for pumping the developer liquid, and a nozzle 47*c* installed at an end near the development gap G for jetting the developer liquid to the development gap G.

The drying unit 30 includes a drying roller 31 for absorbing the carrier remaining on the photoreceptor belt 10, a regeneration roller 33 for regenerating the absorbed liquid carrier into a vapor carrier by heating the drying roller 31 while rotating in contact with the drying roller 31, and a condenser 35 for condensing the vapor carrier. The carrier condensed by the condenser 35 is stored in a condensation tank 49 which is a constituent of the ink delivery system 40.

Also, a three-way valve 48*a* disposed in a carrier supply path and having three inlets and one outlet, and a pump 48*b*, are included in the ink delivery system 40, so that the concentrated ink or carrier accommodated in the ink cartridge 41, the carrier cartridge 43 and the condensation tank 49 is selectively supplied to the circulation tank 44.

The valve 48*a* and pump 48*b* operate according to the concentration and volume of the developer liquid contained in the circulation tank 44, sensed by the concentration sensor 45 and/or upper and lower limit level sensors 46*a* and 46*b*.

As described above, in the conventional ink delivery system 40 for a liquid electrophotographic printer, when the carrier is used up, the entire carrier cartridge 43 must be replaced.

Thus, to supply the carrier exclusively used for a liquid electrophotographic printer, a user must buy a carrier cartridge as well as an ink cartridge for replacement, which is costly and burdensome.

Also, when the concentrated ink is used up, the entire ink cartridge must be replaced. At this time, functional parts such as an agitator included in the ink cartridge must be replaced as a whole, which raises the cost of the ink cartridge.

SUMMARY OF THE INVENTION

To solve the above problem, it is an objective of the present invention to provide an ink delivery system for a liquid electrophotographic printer, in which a carrier cartridge for supplying a carrier used for development is replaced with a carrier tank and a carrier is separated from concentrated ink supplied through an ink cartridge to then be recycled.

Accordingly, to achieve the above objective, there is provided an ink delivery system for a liquid electrophotographic printer including a circulation tank connected to the development units and in which the developer liquid to be supplied to the development unit is stored, a jet portion disposed between the circulation tank and the development unit, for jetting the developer in the circulation tank to a development gap in the development unit, an ink supplier in which concentrated ink is stored, a first supply path through which the concentrated ink accommodated in the ink supplier is supplied to the circulation tank, a carrier tank fixed in a printer body and in which the carrier to be supplied to the circulation tank is stored, a second supply path through which the carrier in the carrier tank is supplied to the circulation tank, a waste ink disposal tank connected to the circulation tank, for collecting the waste ink from the circulation tank, and filtering means installed between the waste ink disposal tank and the carrier tank, for filtering the waste ink in the waste ink disposal tank to supply the carrier to the carrier tank.

BRIEF DESCRIPTION OF THE DRAWINGS

The above objective and advantages of the present invention will become more apparent by describing in detail a preferred embodiment thereof with reference to the attached drawings in which.

DESCRIPTION OF THE PREFERRED EMBODIMENTS

Figure 1:
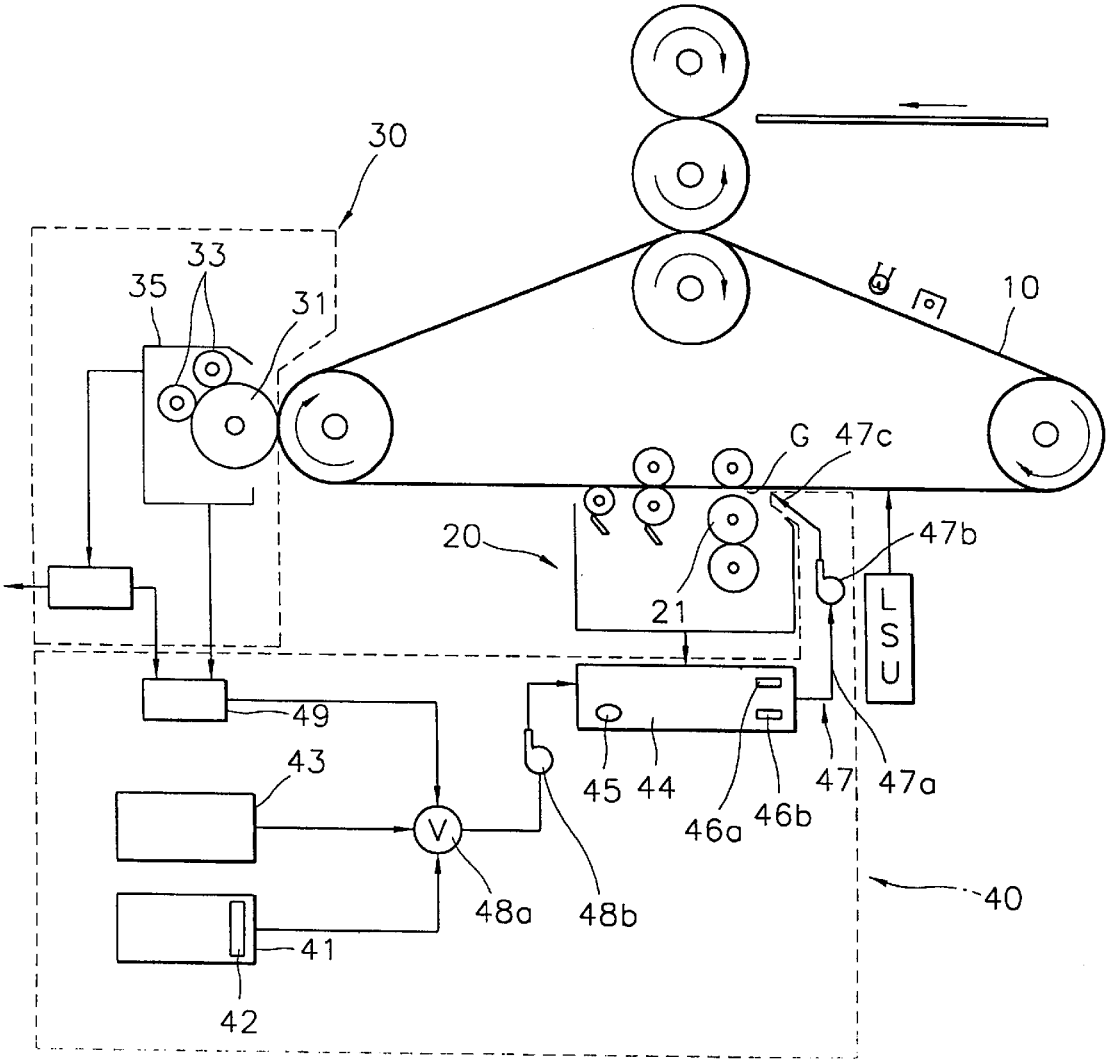
FIG. 1(PRIOR ART)
FIG. 1 is a schematic diagram of a conventional ink delivery system for a liquid electrophotographic printer.
Figure 2:
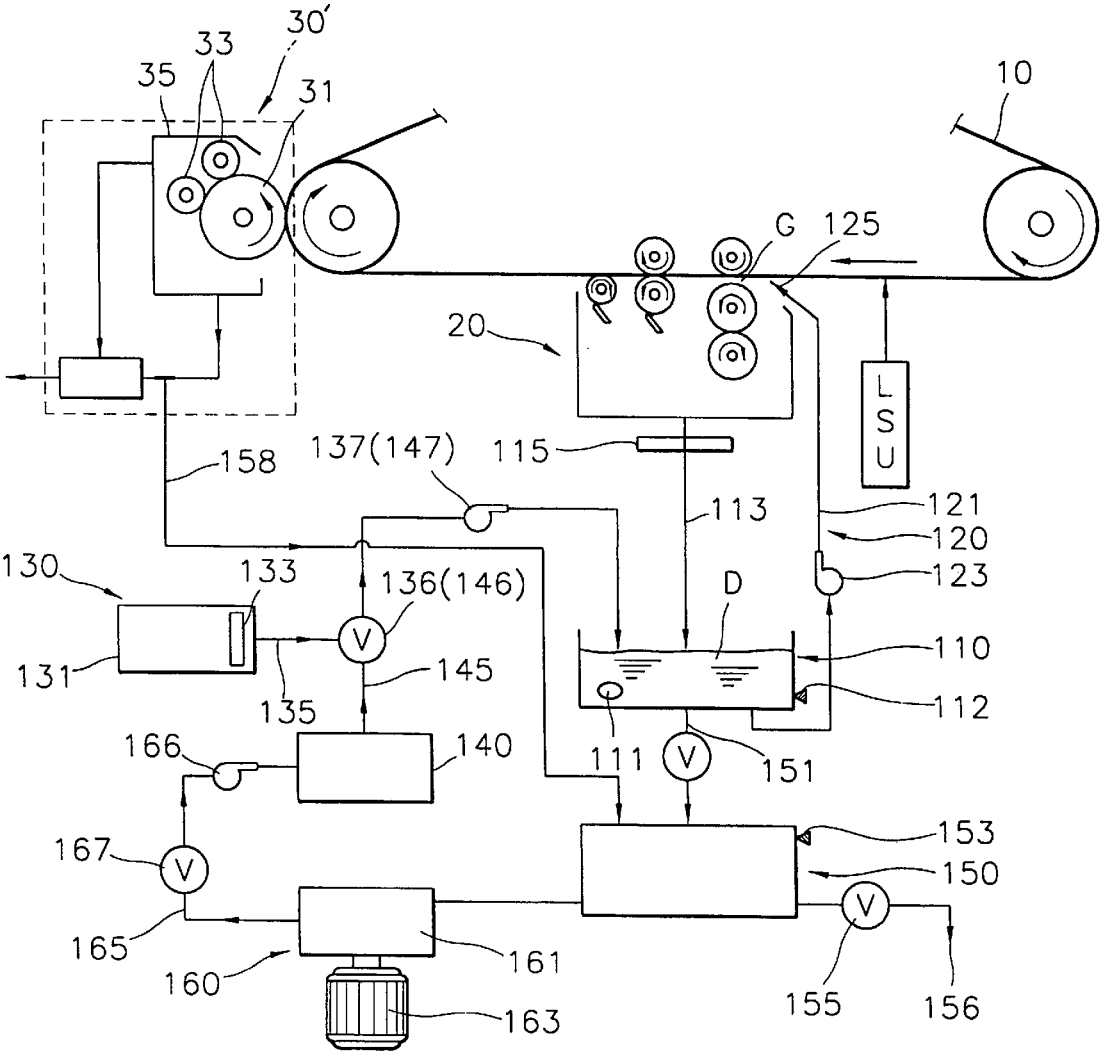
FIG. 2 is a schematic diagram of an ink delivery system for a liquid electrophotographic printer according to an embodiment of the present invention.

Referring to FIG. 2, in an ink delivery system for a liquid electrophotographic printer according to an embodiment of the present invention, developer liquid having a predetermined concentration and volume suitable for development, is supplied to a development unit 20, and the carrier is dried/condensed by a drying/condensing unit 30' after being used for development so that it may then be recovered.

The ink delivery system includes a circulation tank 110 for supplying developer liquid D to a development unit 20, a jet portion 120 for jetting the developer liquid D contained in the circulation tank 110 to a development gap G of the development unit 20, an ink supplier 130 in which concentrated ink is stored, a carrier tank 140 in which the carrier is stored, a waste ink disposal tank 150 for collecting waste ink from the circulation tank 110, and filtering means 160 for filtering the waste ink in the waste ink disposal tank 150 and supplying a carrier to the carrier tank 140. Also, the system includes a plurality of paths connecting the development unit 20, the circulation tank 110, the ink supplier 130, the carrier tank 140, the waste ink disposal tank 150 and the filtering means 160.

Here, the developer liquid refers to ink having about 2~4 wt % toner concentration, obtained by mixing concentrated ink containing about 9 wt % powdered toner supplied from the ink supplier 131 with a liquid carrier supplied from the carrier tank 140 in a predetermined ratio.

The circulation tank 110 is installed under the development unit 20, supplies developer liquid through the jet portion 120 to the development unit 20, and accommodates the residual developer liquid after being used for development so that the accommodated developer liquid D is continuously supplied to the development gap G during development.

A concentration sensor 111 for sensing the concentration of the accommodated developer liquid D is installed in the circulation tank 110, and a lower limit level sensor 112 for sensing the accommodated amount of the developer liquid D is installed in the outer lower portion of the circulation tank 110.

Here, a filter 115 for removing foreign matter contained in the developer liquid is preferably comprised so that the developer liquid delivered into the development unit 20 is recovered in the circulation tank 110. The filter 115 is installed in the developer liquid recovery path 113. Although the filter 115 is indicated in the drawing as if it were separated from the development unit 20, it is preferably incorporated in the lower portion of the development unit 20. In this case, the filter 115 is replaced together with the development unit 20 when necessary.

The jet portion 120 includes a jet path 121 through which the developer liquid is supplied, a jet pump 123 installed in the jet path 121 for pumping the developer liquid, and a nozzle 125 installed at an end near the development gap G of the jet path 121 for jetting the developer liquid to the development gap G.

The ink supplier 130 includes an ink cartridge 131 detachably installed in a printer body (not shown), and an agitator 133 for agitating the concentrated ink accommodated in the ink supplier 130. In this case, the ink cartridge 131 is replaceable when the ink accommodated therein is used up. The concentrated ink accommodated in the ink supplier 130 is supplied to the circulation tank 110 through a first supply path 135 connected between the ink supplier 130 and the circulation tank 110. The first supply path 135 includes a valve 136 installed so as to adjust the amount of concentrated ink supplied, and a pump 137 for pumping the concentrated ink. Also, if the ink cartridge 131 is installed to be higher than the circulation tank 110, since the concentrated ink can be supplied by its own weight, it is not necessary to use the pump 137.

The carrier tank 140 is fixed in a printer body and the carrier to be supplied to the circulation tank 110 is stored therein. The carrier stored in the carrier tank 140 is supplied to the circulation tank 110 through a second supply path 145. Therefore, the carrier in the carrier tank 140 is gradually consumed, and the consumed amount of the carrier is refilled by the carrier supplied via the filtering means 160, which is described later. As described above, since the carrier in the carrier tank 140 is refilled, a separate carrier cartridge for replacement is not necessary.

A valve 146 for adjusting the amount of the carrier to be supplied and a pump 147 for pumping the carrier to be supplied are installed along the second supply path 145.

Although the first and second supply paths 135 and 145 are described separately herein, as shown in FIG. 2, valves for the first and second supply paths 135 and 145 are replaced with a single valve, that is, a two-way valve, and the concentrated ink in the ink cartridge 130 and the carrier in the carrier tank 140 can be sequentially supplied to the circulation tank 110 by a single pump.

The waste ink disposal tank 150 connected to the circulation tank 110 by an ink exhaust path 151 collects the waste ink in the circulation tank 110. An upper limit level sensor 153 for sensing the upper limit level of the waste ink is installed at the waste ink disposal tank 150 so that overflow of waste ink accommodated in the waste ink disposal tank 150 can be prevented. Some of the waste ink accommodated in the waste ink disposal tank 150 is exhausted to the outside of the printer body through an exhaust outlet 156 opened/shut by a valve 155, and most of the waste ink accommodated in the waste ink disposal tank 150 is exhausted to the filtering means 160.

Alternatively, the exhaust outlet 156 may be omitted from the waste ink disposal tank 150. In this case, if it is sensed by the upper limit level sensor 153 that the waste ink is full, the overall waste ink disposal tank 150 may be replaced.

Also, a carrier recovery path 158 connected between the drying/condensing unit 30' to the waste ink disposal tank 150, for recovering the carrier condensed by the drying/condensing unit 30' after being used for development in the waste ink disposal tank 150, may be further installed. Here, the drying/condensing unit 30' includes a drying roller 31 for absorbing the carrier remaining on the photoreceptor belt 10, a regeneration roller 33 for regenerating the absorbed liquid carrier into a vapor carrier by heating the drying roller 31 while rotating in contact with the drying roller 31, and a condenser 35 for condensing the vapor carrier. The carrier condensed by the condenser 35 is recovered in the waste ink disposal tank 150 through the carrier recovery path 158.

Here, the carrier recovery path 158 can be disposed between the condenser 35 and the carrier tank 140 so that the condensed carrier can be directly recovered in the carrier tank 140, instead of the waste ink disposal tank 150.

The filtering means 160 disposed between the waste ink disposal tank 150 and the carrier tank 140, filters the waste ink supplied from the waste ink disposal tank 150.

The filtering means 160 includes a filtering container 161 accommodating the waste ink supplied from the waste ink disposal tank 150 for filtering the accommodated waste ink, a driver 163 for rotating the filtering container 161 so that the waste ink in the filtering container 161 is separated into a toner and a carrier by a centrifuge, and a third supply path 165 through which the carrier separated in the filtering container 161 is delivered to the carrier tank 140. Here, since the toner is solid particles precipitated in the filtering container 161 during the centrifuge operation, pure carrier can be filtered. Since the filtering container 161 and the driver 163 can be implemented by a well-known centrifuge, the detailed explanation thereof will be omitted herein.

The third supply path 165 includes a pump 166 connected between the filtering container 161 and the carrier tank 140 for pumping the separated carrier, and a valve 167 for controlling the supply amount and timing of the carrier.

Hereinbelow, the operation of the ink delivery system for a liquid electrophotographic printer according to an embodiment of the present invention will be described with reference to FIG. 2.

During a development mode, while the developer liquid D in the circulation tank 110 is delivered to the development unit 20 through the jet portion 120, an image is developed corresponding to the latent electrostatic image formed on the photoreceptor belt 10. At this time, the concentration sensor 111 and the lower limit level sensor 112 installed at the circulation tank 110 sense the concentration and amount of the developer liquid D remaining in the circulation tank 110. If a concentration of the developer liquid D less than or greater than the allowed range is sensed by the concentration sensor 111, the amount of necessary concentrated ink supplied from the ink cartridge 131 is supplied to the circulation tank 110 through the first supply path 135 and the amount of necessary carrier supplied from the carrier tank 140 is supplied to the circulation tank 110 through the second path 145. At this time, the amount exceeding the capacity of the circulation tank 110 is exhausted to the waste ink disposal tank 150 through an exhaust path 151.

The waste ink disposal tank 150 recovers the carrier delivered from the circulation tank 110 and the carrier delivered from the drying/condensing unit 30' through the first recovery path 158.

Most of the waste ink in the waste ink disposal tank 150 is exhausted to the filtering means 160 and is separated into the carrier and the toner by the centrifuge in the filtering means 160. Since a trivial amount of toner is precipitated in the filtering container 161, the centrifuge operation is not affected by the precipitated carrier. The separated carrier is delivered to the carrier tank 140 through the third supply path 165 to then be used in refilling the consumed carrier. Here, the carrier used for refilling is separated from the concentrated ink and is continuously supplied by the ink supplier 130. The concentrated ink in the ink cartridge 131 is continuously consumed and refilled from the concentrated ink supplied from the ink supplier 130.

A filter 115 is installed between the development unit and the circulation tank 110 and filters foreign matter contained in the developer liquid.

Figure 3:
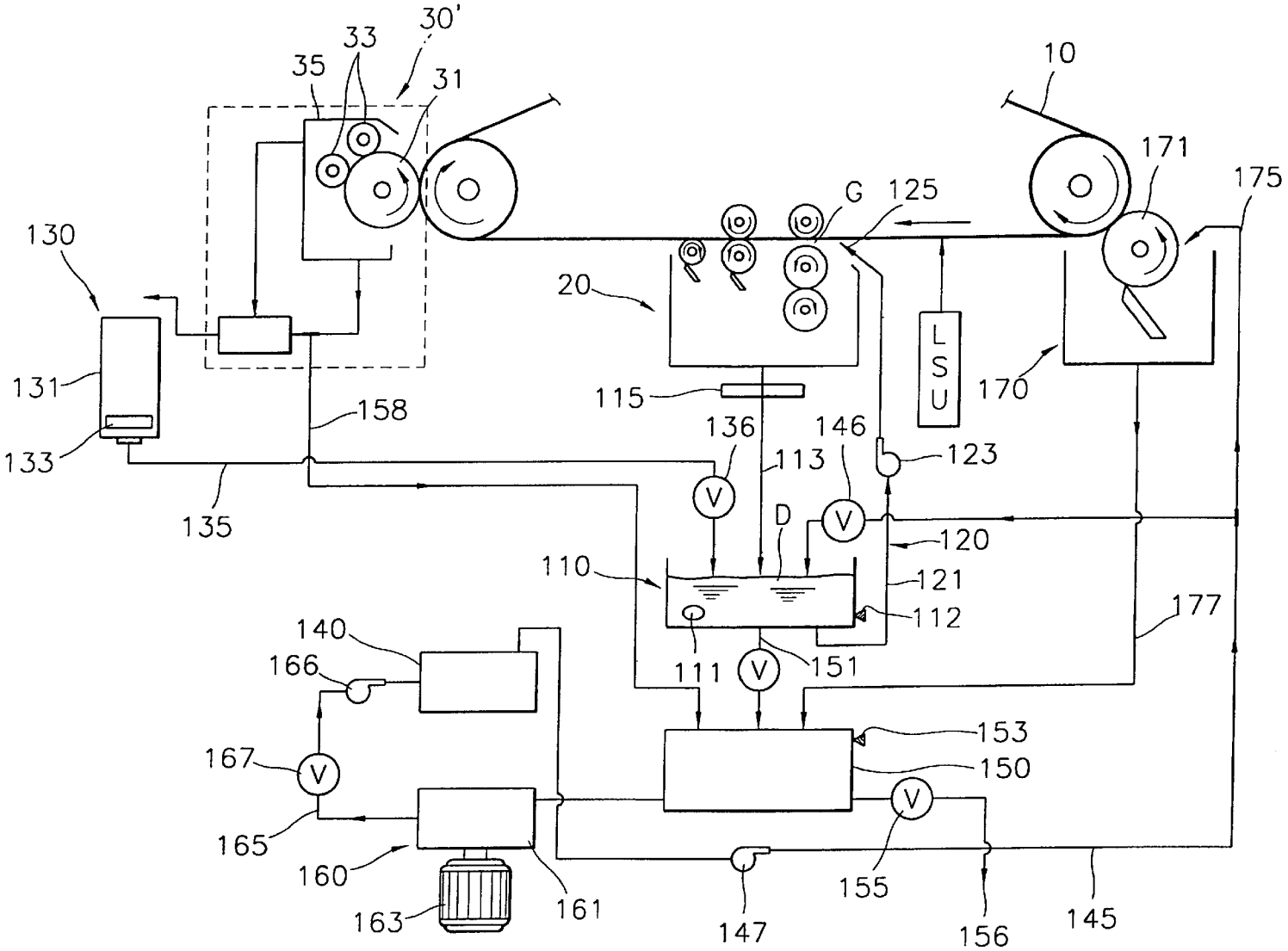
FIG. 3 is a schematic diagram of an ink delivery system for a liquid electrophotographic printer according to another embodiment of the present invention.

FIG. 3 is a schematic diagram of an ink delivery system for a liquid electrophotographic printer according to another embodiment of the present invention. Here, the same reference numerals as those in FIG. 2 represent the same elements and thus a detailed explanation thereof will be omitted.

The feature of this embodiment is that there is further provided a cleaning means for cleaning the photoreceptor belt 10 using a carrier supplied from a carrier tank 140.

The cleaning means includes a cleaning unit 170 having a cleaning roller 171 rotating in contact with a photoreceptor belt 10, for cleaning the photoreceptor belt 10, a fourth supply path 175 through which the carrier is supplied to the cleaning roller 171, and a carrier exhaust path 177 through which the carrier in the cleaning unit 170 is delivered to the waste ink disposal tank 150. The fourth supply path 175 is a path through which the carrier pumped by the pump 147 of the second supply (and exhaust) path 145 is supplied to the cleaning unit 170. The carrier exhaust path 177 is a path through which the carrier used in cleaning is delivered to the waste ink disposal tank 150 by natural gravitational flow due to the fact that the cleaning unit 170 is installed higher than the waste ink disposal tank 150. In this embodiment, although the first exhaust path 135 and the second exhaust (and supply) path 145 are constructed separately to supply the concentrated ink and the carrier to the circulation tank 110, respectively, this is only an illustrative example. Here, the ink cartridge 131 may be installed higher than the circulation tank 110, thereby supplying the concentrated ink by its own weight, without using a pump.

Figure 4:
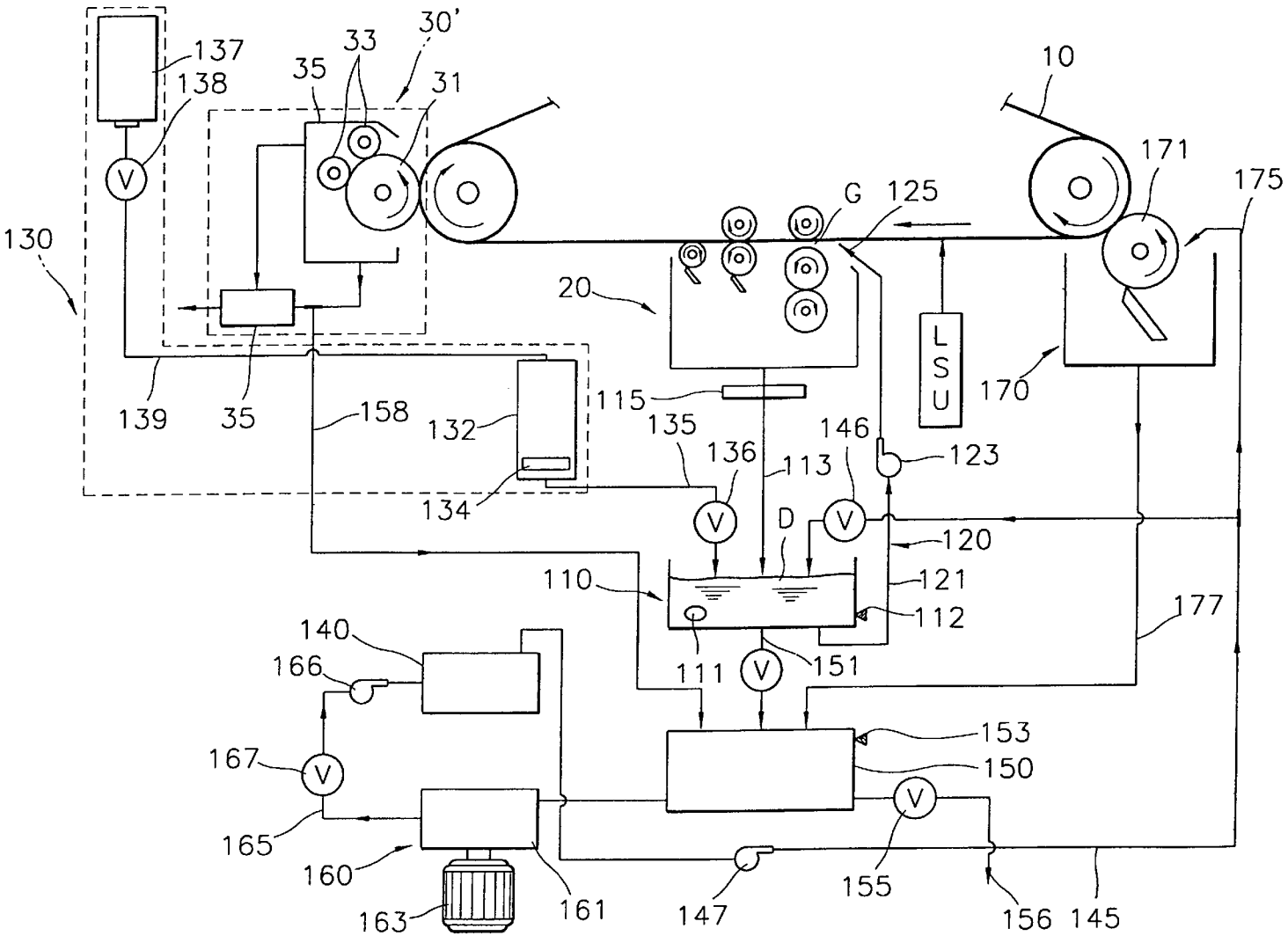
FIG. 4 is a schematic diagram of an ink delivery system for a liquid electrophotographic printer according to still another embodiment of the present invention.

FIG. 4 is a schematic diagram of an ink delivery system for a liquid electrophotographic printer according to still another embodiment of the present invention. Here, the same reference numerals as those in FIGS. 2 and 3 represent the same elements and thus a detailed explanation thereof will be omitted.

The feature of this embodiment is that there is further provided the ink supplier 130 including an ink tank 132 fixed on the printer body, and a refill ink cartridge 137 for supplying concentrated ink when the concentrated ink in the ink tank 132 is used up.

The concentrated ink accommodated in the ink tank 132 is supplied to the circulation tank 110 through the first supply path 135, and receives the concentrated ink from the refill ink cartridge 137 through an ink refill path 139. Functional parts, e.g., an agitator 134 for agitating the concentrated ink accommodated in the ink tank 132, are installed in ink tank 132. The refill ink cartridge 137 is detachably installed in the printer body, and functional parts are not included therein. Since the refill ink cartridge 137 is installed only when the concentrated ink is fully filled in the ink tank 132, it does not occupy additional space in the printer body. A shut-off valve 138 opened/shut according to detachment of the refill ink cartridge 137 is installed in the ink refill path 139 to supply the concentrated ink in one direction.

As described above, since the ink delivery system for a liquid electrophotographic printer according to the present invention has a carrier tank and a carrier recovery system for supplying the carrier, a separate carrier cartridge is not necessary. Thus, special consideration of user convenience is not necessary, and spatial availability of a printer body is enhanced. Also, since a single lower limit level sensor is used for sensing the level of the developer liquid in the circulation tank, the number of sensors is reduced.

If an ink supply portion is separated into an ink tank and a refill ink cartridge, it is not necessary to replace the ink tank during development. When the ink is used up, functional parts are not necessarily replaced together with an ink cartridge, which leads to low cost disposables.

It is conceivable that numerous modifications may be made to the ink delivery system for a liquid electrophotographic printer of the present invention without departing from the spirit and scope of the invention as defined in the following claims.

What is claimed is:

1. An ink delivery system for a liquid electrophotographic printer which is capable of delivering a developer liquid of a predetermined concentration which is a mixture of a toner and a liquid carrier to a development unit, comprising:

a circulation tank connected to the development unit and in which the developer liquid to be supplied to the development unit is stored;

a jet portion disposed between the circulation tank and the development unit, for jetting the developer in the circulation tank to a development gap in the development unit;

an ink supplier in which concentrated ink is stored;

a first supply path through which the concentrated ink is stored;

a first supply path through which the concentrated ink accommodated in the ink supplier is supplied to the circulation tank;

a carrier tank fixed in a printer body and in which the carrier to be supplied to the circulation tank is stored;

a second supply path through which the carrier in the carrier tank is supplied to the circulation tank;

a waste ink disposal tank connected to the circulation tank, for collecting waste ink from the circulation tank; and filtering means installed between the waste ink disposal tank and the carrier tank, for separating the waste ink from the waste ink disposal tank into the carrier and the toner to supply the carrier to the carrier tank.

2. The ink delivery system according to claim 1, wherein the circulation tank further comprises:

a concentration sensor for sensing a concentration of the developer liquid accommodated in the circulation tank; and a level sensor for sensing a lower limit level of the accommodated developer liquid.

3. The ink delivery system according to claim 1, wherein the ink supplier comprises:

an ink cartridge detachably installed in the printer body; and an agitator installed in the ink cartridge, for agitating the concentrated ink accommodated in the ink cartridge.

4. The ink delivery system according to claim 1, wherein the ink supplier comprises:

an ink tank fixed on the printer body;

an agitator installed in the ink tank, for agitating the concentrated ink accommodated in the ink tank; and a refill ink cartridge for supplying concentrated ink to the ink tank when the concentrated ink in the ink tank is used up.

5. The ink delivery system according to claim 1, wherein the filtering means comprises:

a filtering container accommodating the waste ink supplied from the waste ink disposal tank, for filtering the accommodated waste ink;

a driver for rotating the filtering container so that the waste ink in the filtering container is centrifuged to then be separated into a toner and a carrier; and a third supply path through which the carrier separated in the filtering container is delivered to the carrier tank.

6. The ink delivery system according to claim 1, further comprising:

a carrier recovery path installed between a drying/condensing unit and the waste ink disposal tank, for recovering the carrier condensed by the drying/condensing unit after being used for development.

7. The ink delivery system according to claim 1, further comprising:

a filter installed in a developer liquid carrying path between the development unit and the circulation tank, for filtering foreign matter contained in the developer liquid.

8. The ink delivery system according to claim 1, further comprising:

cleaning means for cleaning a photosensitive medium using the carrier supplied from the carrier tank.

9. An ink delivery system for a liquid electrophotopraphic printer which is capable of delivering a developer liquid of a predetermined concentration which is a mixture of a toner and a liquid carrier to a development unit, comprising:

a circulation tank connected to the development unit and in which the developer liquid to be supplied to the development unit is stored;

a jet portion disposed between the circulation tank and the development unit, for jetting the developer in the circulation tank to a development gap in the development unit;

an ink supplier in which concentrated ink is stored;

a first supply path through which the concentrated ink accommodated in the ink supplier is supplied to the circulation tank;

a carrier tank fixed in a printer body and in which the carrier to be supplied to the circulation tank is stored;

a second supply path though which the carrier in the carrier tank is supplied to the circulation tank;

a waste ink disposal tank connected to the circulation tank, for collecting waste ink from the circulation tank;

filtering means installed between the waste ink disposal tank and the carrier tank, for filtering the waste ink from the waste ink disposal tank to supply the carrier to the carrier tank;

cleaning means for cleaning a photosensitive medium using the carrier supplied from the carrier tank;

wherein the cleaning means comprises:

a cleaning unit having a cleaning roller for cleaning the photosensitive medium while rotating in contact with the photosensitive medium;

a fourth supply path connected to the second supply path, for supplying the carrier to the cleaning roller; and a carrier exhaust path for delivering the carrier in the cleaning unit to the waste ink disposal tank.

10. An ink delivery system for a liquid electrophotographic printer which is capable of delivering a developer liquid of a predetermined concentration which is a mixture of a toner and a liquid carrier to a development unit, comprising:

a circulation tank connected to the development unit and in which the developer liquid to be supplied to the development unit is stored;

a jet portion disposed between the circulation tank and the development unit, for jetting the developer in the circulation tank to a development gap in the development unit;

an ink supplier in which concentrated ink is stored;

a first supply path through which the concentrated ink is stored;

a first supply path through which the concentrated ink accommodated in the ink supplier is supplied to the circulation tank;

a carrier tank fixed in a printer body and in which the carrier to be supplied to the circulation tank is stored;

a second supply path through which the carrier in the carrier tank is supplied to the circulation tank;

a waste ink disposal tank connected to the circulation tank, for collecting waste ink from the circulation tank; and a filtering mechanism installed between the waste ink disposal tank and the carrier tank, for separating the waste ink from the waste ink disposal tank into the carrier and the toner to supply the carrier to the carrier tank.

* * * * *